US006995758B2

(12) United States Patent
Fukuda

(10) Patent No.: US 6,995,758 B2
(45) Date of Patent: Feb. 7, 2006

(54) DISPLAY DRIVER AND DISPLAY DEVICE USING THE DISPLAY DRIVER

(75) Inventor: Masafumi Fukuda, Chino (JP)

(73) Assignee: Seiko Epson Corporation, Tokyo (JP)

( * ) Notice: Subject to any disclaimer, the term of this patent is extended or adjusted under 35 U.S.C. 154(b) by 468 days.

(21) Appl. No.: 09/964,437

(22) Filed: Sep. 28, 2001

(65) Prior Publication Data

US 2002/0044142 A1 Apr. 18, 2002

Related U.S. Application Data

(63) Continuation of application No. PCT/JP01/00702, filed on Feb. 1, 2001.

(30) Foreign Application Priority Data

Feb. 2, 2000 (JP) ..... 2000-025715

(51) Int. Cl.
*G09G 3/36* (2006.01)

(52) U.S. Cl. ..... 345/205; 345/211; 345/87; 345/98; 345/100

(58) Field of Classification Search ..... 345/87, 345/88, 89, 98, 99, 100, 204, 205, 206, 211, 345/212, 213
See application file for complete search history.

(56) References Cited

U.S. PATENT DOCUMENTS 5,250,931 A * 10/1993 Misawa et al. ..... 345/206
5,610,627 A 3/1997 Inamori et al.
5,627,457 A 5/1997 Ishiyama et al.
5,745,092 A * 4/1998 Ito ..... 345/95
5,751,278 A 5/1998 Inamori et al.
5,764,225 A 6/1998 Koshobu
5,774,106 A 6/1998 Nitta et al.
5,907,313 A 5/1999 Kubota et al.
6,046,633 A * 4/2000 Shimizu ..... 330/51
6,067,062 A * 5/2000 Takasu et al. ..... 345/87
6,118,425 A * 9/2000 Kudo et al. ..... 345/100
6,411,273 B1 * 6/2002 Nakamura et al. ..... 345/98

FOREIGN PATENT DOCUMENTS

EP 0 479 304 A2 10/1990
EP 0 633 516 A1 1/1995
JP 11311804 11/1999

* cited by examiner

*Primary Examiner*—Xiao Wu
(74) *Attorney, Agent, or Firm*—Oliff & Berridge, PLC

(57) ABSTRACT

The present invention aims at providing a display driver and a display device using such a display driver which can prevent the deterioration of the display quality of a display section by suppressing the drop of a power source voltage between respective display drivers. When a COG-mounted liquid crystal display panel whose mode can be changed over between a master mode and a slave mode is driven by a plurality of display drivers, the display driver at the master side which is set in the master mode supplies the power source voltages for driving liquid crystal generated by a voltage generating part due to input switching parts to power source voltage input terminals of the display driver at the slave side using operational amplifiers. The display driver at the slave side generates the power source voltage for driving the liquid crystal from the power source voltage supplied from the power source voltage input terminals by input switching parts using the voltage-follower connected operational amplifiers.

15 Claims, 9 Drawing Sheets

DISPLAY DRIVER AND DISPLAY DEVICE USING THE DISPLAY DRIVER

Japanese Patent Application No. 2000-25715 filed on Feb. 2, 2000 is hereby incorporated by reference in its entirety. This is a continuation of International Application No. PCT/JP01/00702 filed on Feb. 1, 2001 which is hereby incorporated by reference in its entirety.

BACKGROUND OF THE INVENTION

1. Field of the Invention

The present invention relates to a display driver for driving a display section and a display device using the display driver.

2. Description of Related Art

In a display device which includes a liquid crystal panel (a display panel in a broader sense) having a large display capacity such as a LCD for vehicle mounting, a LCD for a copying machine or the like, the display driving is performed using a plurality of display drivers (liquid crystal driving circuits) In general, these display drivers are constituted such that they are classified into the master side and the slave side. In this case, conventionally, a liquid crystal driving power source circuit is arranged only at the master-side display driver and a liquid crystal driving power source circuit is not arranged at the slave-side display drivers.

FIG. 8 schematically shows the constitution of the conventional display device which includes the master-side display driver and the slave-side display drivers.

At the master-side display drivers a resistor 10 is inserted between a power source voltage $V_{DD}$ at the high potential side and a power source voltage $V_{SS}$ at the lower potential side. Potentials V1, V2 which are divided by the resistor 10 are inputted into operational amplifiers 21, 22 to which negative feedback loops are formed. Voltages V11, V12 which are substantially equal to the input potentials are outputted from these operational amplifiers.

At the master side, the voltage V11 which is outputted from the operational amplifier 21 is supplied to a series of driver cells 31, 32, 33, . . . for driving liquid crystal as a power source. Further, the voltage V12 which is outputted from the operational amplifier 22 is supplied to a series of driver cells 31, 32, 33, . . . for driving liquid crystal as a power source.

The voltages V11, V12 which are outputted from the master-side operational amplifiers 21, 22 are also supplied to the slave side as voltages V11', V12' through interconnecting lines 51, 52 formed on an interconnect layer on a glass substrate. At the slave side, the voltage V11' is supplied to a series of driver cells 71, 72, 73, . . . for driving liquid crystal as a power source. Further, the voltage V12' is supplied to a series of driver cells 71, 72, 73, . . . for driving liquid crystal as a power source.

However, recently, there has been a tendency that the area of a liquid crystal panel is enlarged so as to increase a capacity of the liquid crystal panel. Accordingly, the electric power capacity which is required at the slave side is also increased. Further, in a chip-on-glass (Chip On Glass: abbreviated as COG hereinafter) structure which forms integrated display drivers on a glass substrate, the thickness of an interconnect layer is thin and hence, the resistance of the interconnecting line which connects the master side and the slave side is increased. Accordingly, a voltage drop occurs between the master-side power source voltages V11, V12 and the slave-side power source voltages V11', V12'.

In FIG. 9, schematic waveforms of the master-side power source voltages V11, V12 and of the slave-side power source voltages V11', V12' are shown.

In this manner, since the parasitic resistance is inserted to the interconnecting line which connects the master side and the slave side, the capacity of the driver output becomes different between the master side and the slave side. To be more specific, compared to the output waveform of the master-side power source voltages V11, V12, the output waveform of the slave-side power source voltages V11', V12' loses sharpness. As a result, there arises problems such as giving rise to the deviation in bias on the whole screen and the display quality becoming different between the master side and the slave side due to the occurrence of the block irregularities at a portion of the screen.

SUMMARY

The present invention has been made in view of the above-mentioned technical problems and it is an object of the present invention to provide a display driver which, when a display section is driven using a plurality of display drivers, can suppress the drop of the power source voltage between respective display drivers thus preventing the deterioration of the display quality of the display section and a display device using such display drivers.

The present invention which solves the above-mentioned problems is directed to a display driver which drives a display panel comprising:

voltage generating means which generate a given voltage;

a voltage-follower-type operational amplifier circuit which generates a driving voltage based on the given voltage; and switching means for causing the voltage-follower-type operational amplifier circuit to generate the driving voltage based on the given voltage in a first mode and causing the voltage-follower-type operational amplifier circuit to generate the driving voltage based on an external voltage supply in a second mode.

Here, the voltage-follower-type operational amplifier circuit means a so-called voltage-follower connected operational amplifier circuit in which a negative feedback loop is formed from an output terminal thereof.

According to the present invention, the display driver is constituted such that the operation thereof is changed over between the first mode which generates the driving voltages based on the voltages generated by the voltage generating means and the second mode which generates the driving voltages based on the voltages supplied from the outside. Further, the display driver makes the voltage-follower connected operational amplifier circuit generate the driving voltages. Due to such a constitution, when a display panel having an increased capacity is driven by a plurality of display drivers, the display driving can be performed using a plurality of same display drivers so that a manufacturing cost of chips for display drivers suitable for the display driving can be reduced. Particularly, by making the operational amplifier circuit connected in the voltage-follower manner with the negative feedback output terminal, the input impedance can be increased so that an input current can be reduced and the voltage drop of the supply voltages from the outside can be prevented whereby the above-mentioned driving voltages can be generated.

Further, the present invention is characterized in that the display driver may be mounted on a glass substrate on which a display panel is formed, and the external voltage supply in the second mode maybe supplied through a transparent conductive film formed on the glass substrate.

According to the present invention, the first and second display drivers which are set in the above-mentioned first mode and second mode and the display panel which is driven by these display drivers are mounted on the same glass substrate as COG. Due to such a constitution, even when the transparent conductive film is used as an interconnecting line which electrically connects respective parts mounted on the glass substrate so that the interconnect resistance cannot be ignored, the input impedance of the operational amplifier circuit is extremely large so that an input current hardly flows into the circuit. Accordingly, the voltage drop of the voltages supplied from the outside through the interconnecting line hardly occurs. As a result, the deviation in bias or the block irregularities on a screen of the display device can be prevented so that the deterioration of the display quality can be prevented. Further, with the provision of the COG mounting, the space saving of the picture frame and the reduction of the mounting steps and the number of parts can be realized. Further, since the current supply ability can be increased at respective display drivers, a large-sized screen liquid crystal panel having a heavy load can be also sufficiently driven.

Further, in the present invention, when the display panel is driven by a plurality of the display drivers, the first mode may be a mode which generates a reference voltage for the driving voltage which is generated by another display driver, and when the display panel is driven by a plurality of the display drivers, the second mode may be a mode which generates the driving voltage based on the reference voltage generated by the display driver set in the first mode.

According to the present invention, when the display panel is driven by a plurality of display drivers, the first mode is set with respect to one display driver and the second mode is set with respect to the remaining display drivers, whereby when the reference voltage for the driving voltage which is generated by the display driver set in the first mode is distributed to the display drivers set in the second mode, the voltage drop between the respective display drivers hardly occurs. Accordingly, the deviation in bias and the block irregularities on the screen of the-display device can be prevented thus preventing the deterioration of the display quality.

Further, the present invention is characterized in that the voltage generating means may generate the given voltage by dividing a potential difference between a given power source voltage at a high potential side and a given power source voltage at a low potential side by a resistor.

According to the present invention, the voltage generating means can be configured by the extremely simple constitution and hence, the display drivers can be manufactured at a low cost.

Further, the present invention is characterized in that the display panel may be a simple matrix panel.

Further, a display device according to the present invention comprises:

a first display driver set in a first mode, which is the above-mentioned display driver;

a second display driver set in a second mode, which is the above-mentioned display driver, to which the driving voltage generated by the first display driver is supplied as the external voltage supply; and a display panel which is driven based on the voltage generated at least by the second display driver, wherein the first and second display drivers are mounted on a glass substrate on which the display panel is formed, and wherein the driving voltage generated by the first display driver is supplied to the second display driver through a transparent conductive film which is formed on the glass substrate.

According to the present invention, since the display drivers in the above-mentioned first mode and second mode are mounted on the glass substrate on which the display panel is formed, due to the COG mounting and the reduction of the cost of the drivers, the display device which can cope with the enhancement of the display quality even when the capacity of the display panel is increased can be provided at a low cost.

The present invention is characterized in that the transparent conductive film may have interconnect resistance which is not less than output impedance of the voltage-follower-type operational amplifier circuit of the first display driver.

According to the present invention, the voltage drop which is generated by the parasitic interconnect resistance of the transparent conductive film can be effectively prevented so that the deviation in bias and the block irregularities on a screen of the display device which constitutes a displayed object can be prevented thus realizing the display of high quality.

Further, a display device according to the present invention comprises;

a display panel which is formed on a glass substrate, and a plurality of display drivers which are mounted on the glass substrate and drive the display panel, wherein each of the display drivers includes a voltage-follower-type operational amplifier circuit which generates driving voltage for driving the display panel based on a power source voltage supplied through an interconnecting line formed on the glass substrate.

According to the present invention, in the display device which mounts a plurality of display drivers on the glass substrate on which a display panel is formed, when a power source voltage is supplied to the respective display drivers through an interconnecting line formed on the glass substrate, to each display driver, a voltage-follower connected operational amplifier circuit which generates the driving voltage based on the power source voltage is provided. Due to such a constitution, the voltage drop of the power source voltage supplied to each display driver can be prevented so that the deviation in bias or the block irregularities on the screen of the display device which constitutes the displayed object can be prevented thus preventing the deterioration of the display quality.

Further, the present invention is characterized in that the display panel may be an active matrix panel.

Still further, the present invention is characterized in that the voltage supplied through the interconnecting line may be gray scale driving voltage.

According to the present invention, when the display panel is the active matrix panel, for example, the drive voltage is generated based on the reference voltage at a plurality of levels necessary for the gray scale driving due to the voltage-follower connected operational amplifier circuit and hence, the deterioration of the quality of the gray scale display can be prevented.

Further, the present invention is directed to a display driver that is mounted on a glass substrate on which a display panel is formed and drives the display panel.

wherein the display driver is connected to an interconnecting line to which a power source voltage which is supplied to another semiconductor device mounted on the glass substrate is applied, and wherein the display driver includes a voltage-follower-type operational amplifier circuit which generates driving voltage which drives the display panel based on the power source voltage.

According to the present invention, using the voltage-follower connected operational amplifier circuits, the driving voltages are generated based on the voltages applied to the interconnecting line formed on the same glass substrate and hence, it becomes possible to provide the display drivers suitable for performing the display driving of the active matrix panel, for example.

Further, according to another aspect of the present invention, there may be provided a power source circuit which supplies a power source to at least a first load arranged at a first portion and a second load arranged at a second portion comprising:

means which generates a given potential at the first portion;

a first voltage supply circuit which supplies a first voltage to the first load based on the given potential in the first portion as a power source;

means which transmits the first voltage which is supplied by the first voltage supply circuit to the second portion; and a second voltage supply circuit which supplies a second voltage which has an equivalent value as the transmitted first voltage to the second load as a power source at the second portion.

Further, according to still another aspect of the present invention, the means which generates a given potential may generate a plurality of given potentials which are different from each other, the first voltage supply circuit may supply a plurality of different first voltages based on the plurality of different given potentials, and the second voltage supply circuit may supply a plurality of different second voltages which are equal to the plurality of different first voltages.

Further, according to another aspect of the present invention, there may be provided a liquid crystal display device including a circuit which is arranged while being divided into at least a first portion and a second portion comprising:

means which generates a given potential at the first portion;

a first voltage supply circuit which supplies a first voltage based on the given potential in the first portion;

a first group of liquid crystal driving circuits which are operable using the first voltage which is supplied by the first voltage supply circuit as a power source in the first portion;

means which transmits the first voltage which is supplied by the first voltage supply circuit to the second portion;

a second voltage supply circuit which supplies a second voltage which has an equivalent value as the transmitted first voltage in the second portion; and a second group of liquid crystal driving circuits which are operable using the second voltage which is supplied by the second voltage supply circuit as a power source.

Further, according to still another aspect of the present invention, the above-mentioned means for generating given potential generates a plurality of given potentials which are different from each other, the first voltage supply circuit supplies a plurality of different first voltages based on a plurality of the above-mentioned different given potentials, and the second voltage supply circuit supplies a plurality of different second voltages which have values equal to a plurality of the above-mentioned different first voltages.

In the above-mentioned invention, the means which generates a given potential may generates a plurality of given different potentials, the first voltage supply circuit may supply a plurality of different first voltages based on a plurality of given different potentials, and the second voltage supply circuit may supply a plurality of different second voltages which have values equal to the plurality of different first voltages.

Due to such a constitution, there exists a substantially no flow of power source current between the first portion and the second portion of the liquid crystal display device and hence, it becomes possible to suppress the drop of the power source voltage. Accordingly, the deviation in bias or the block irregularities on the screen of the liquid crystal display device can be prevented.

As has been described above, according to the present invention, by suppressing the drop of the power source voltage between a plurality of portions of the liquid crystal display device, the deviation in bias or the block irregularities on the screen of the display device can be prevented. Further, since the current supply ability of the power source circuit can be increased, the large screen liquid crystal panel with a heavy load can be also sufficiently driven.

DETAILED DESCRIPTION

The embodiments of the present invention are explained in detail with reference to the drawings.

First Embodiment

In a display device (liquid crystal display device) according to the first embodiment of the present invention, a display driving of a liquid crystal panel (display panel in a broader sense) is performed by display drivers (liquid crystal drive circuits) which are constituted by dividing them into two chips at a master side and a slave side. The display driver at the master side includes driver cells 31, 32, 33, . . . . The display driver at the slave side includes driver cells 71, 72, 73, . . . . Although a case in which the display driving of the liquid crystal panel is performed using the two chips in the following description, the present invention is applicable to a case in which a power source voltage which is generated by the division by resistance or the like at the outside of the display drivers is supplied to the display driver having a one chip constitution.

1.1 Summary of the Constitution

Figure 1:
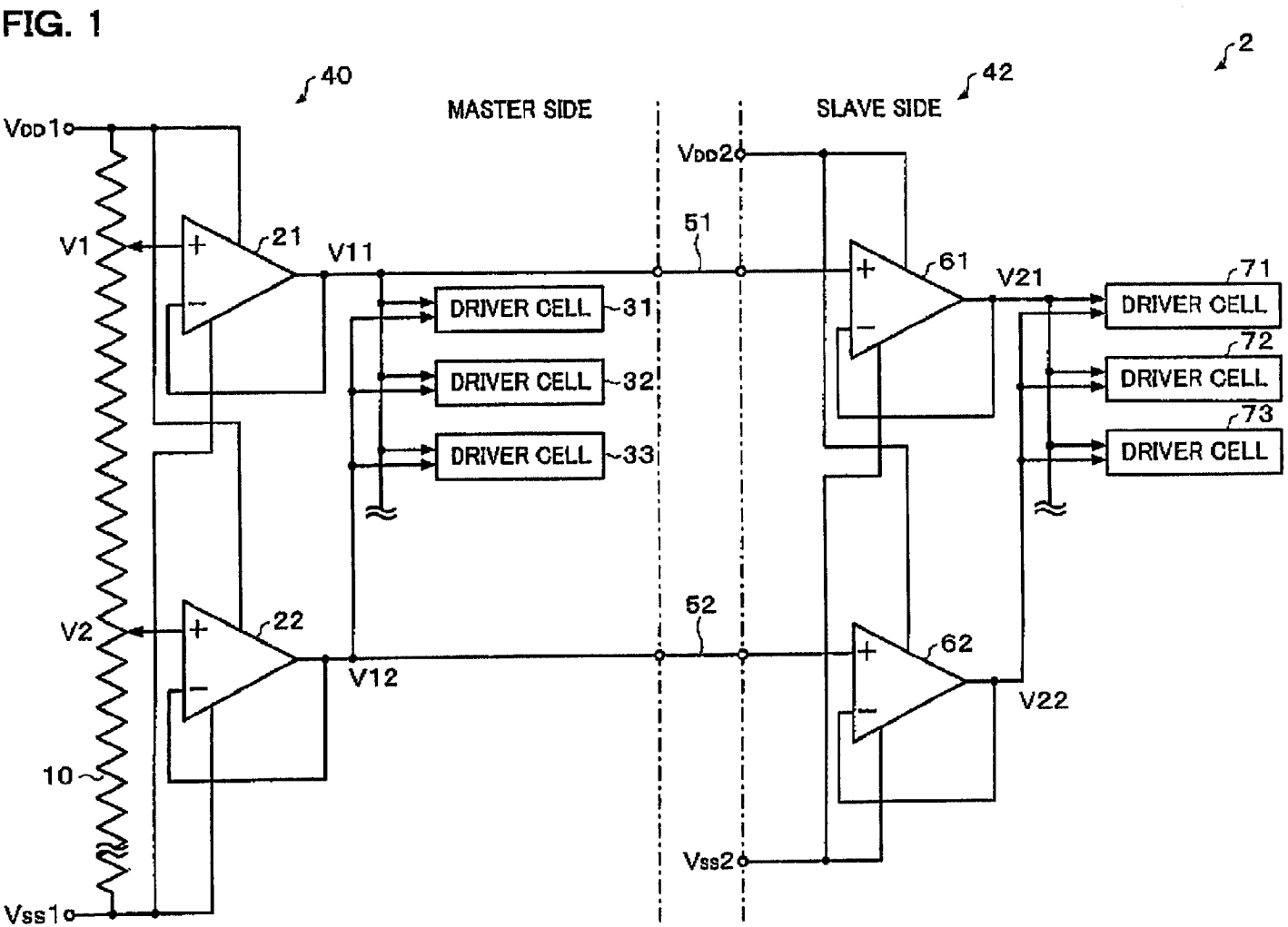
FIG. 1 is a constitutional view showing an essential part of a principle constitution of a display device according to the first embodiment.

FIG. 1 shows an essential part of a principle constitution of a display device according to the first embodiment.

In the display device 2 according to the first embodiment, on a glass substrate on which a liquid crystal panel (not shown in the drawing) is formed, display drivers 40, 42 having two chip constitution of the master side and the slave side are mounted.

The display drivers 40, 42 generate liquid crystal driving voltages at a plurality of levels (for example, V1, V2 in FIG. 1) and supply these voltages selectively to the liquid crystal panel based on display data.

To generate voltages at a plurality of levels based on the display data, the display driver 40 at the master side includes a resistor 10 which is inserted between a power source voltage $V_{DD}$1 at a high potential side and a power source voltage $V_{SS}$1 at a low potential side and generates at least one given voltage. Here, as an example, it is assumed that two voltages V1, V2 are generated by the resistor 10.

Further, the display driver 40 at the master side includes operational amplifiers (operational amplifier circuits in a broader sense) 21, 22 to which the voltages V1, V2 obtained by dividing the voltage between the power source voltage $V_{DD}$1 at the high potential side and the power source voltage $V_{SS}$1 at the low potential side by the resistor 10 are supplied.

Voltages V1, V2 are supplied to first terminals (+terminals) of the operational amplifiers 21, 22. These operational amplifiers 21, 22 constitute voltage-follower-type operational amplifier circuits. That is, to second terminals (– terminals) of the operational amplifiers 21, 22, output terminals of respective operational amplifiers are connected thus forming negative feedback loops thus establishing voltage-follower connections. The power source voltage $V_{DD}$1 at the high potential side and the power source voltage $V_{SS}$1 at the low potential side are supplied to the operational amplifiers 21, 22 and the operational amplifiers 21, 22 output voltages V11, V12 which are equal to the input voltages. Either one of the power source voltage $V_{DD}$1 at the high potential side and the power source voltage $V_{SS}$1 at the low potential side may be used as a ground potential.

The display driver 42 at the slave side includes at least operational amplifiers 61, 62 which respectively correspond to the operational amplifiers 21, 22 of the display driver 40 at the master side.

Voltages outputted from the operational amplifiers 21, 22 of the display driver 40 at the master side are supplied to first terminals (+ terminals) of the operational amplifiers 61, 62. To second terminals (– terminals) of the operational amplifiers 61, 62, output terminals of respective operational amplifiers are connected to form negative feedback loops thus establishing voltage-follower connections. A power source voltage $V_{DD}$2 at the high potential side and a power source voltage $V_{SS}$2 at the low potential side are supplied to the operational amplifiers 61, 62 and the operational amplifiers 21, 22 output voltages which are equal to the input voltages. Either one of the power source voltage $V_{DD}$2 at the high potential side and the power source voltage $V_{SS}$2 at the low potential side may be used as a ground potential.

In the display device 2 having such a constitution, the voltages V11, V12 which are outputted from the operational amplifiers 21, 22 in the display driver 40 at the master side are supplied to a series of driver cells 31, 32, 33, . . . for driving liquid crystal as power sources. Further, these voltages V11, V12 are supplied to the display driver 42 at the slave side through transparent conductive films 51, 52 formed on an interconnect layer on the glass substrate.

In the display driver 42 at the slave side, the voltages V11, V12 which are supplied through the transparent conductive films 51, 52 are respectively inputted to the operational amplifiers 61, 62. Here, since the operational amplifiers 61, 62 adopt the voltage-follower-connection configuration as mentioned previously, feedback factors of the operational amplifiers become extremely large and hence, the input impedance of the operational amplifiers also become extremely large, whereby there exists substantially no flow of the input current. Accordingly, the voltage drop is hardly generated between the display driver 40 at the master side and the display driver 42 at the slave side. As a result, the output voltages of the operational amplifiers 61, 62 become substantially equal to the input voltages so that the voltages V21, V22 which are outputted from the operational amplifiers 61, 62 substantially become equal to the voltages V11, V12 which are outputted from the operational amplifiers 21, 22 of the display driver 40 at the master side.

The voltages V21, V22 which are outputted from the operational amplifiers 61, 62 of the display driver 42 at the slave side are supplied to a series of driver cells 71, 72, 73, . . . for driving liquid crystal.

As means for generating a given potential provided to at least the display driver 40 at the master side, besides the resistor, a diode, a Zener diode, a transistor or the like can be used. Further, circuits which supply voltages are not limited to operational amplifiers and various voltage/current amplifier circuits including active elements can be used as the circuits for supplying voltages.

Incidentally, in a conventional mounting method (for example, a TCP (Tape Carrier Package) mounting), when the display driving of a liquid crystal panel made of a simple matrix panel is performed using liquid crystal driving voltages at a plurality of levels generated by a plurality of display drivers, for example, there arises no problem with respect to the resistance of an interconnecting line between display drivers. Further, it is much better to generate the liquid crystal driving voltages at a plurality of levels only by the display driver at the master side since this could reduce the current consumption of the operational amplifier thus enabling the lower power consumption.

Figure 8:
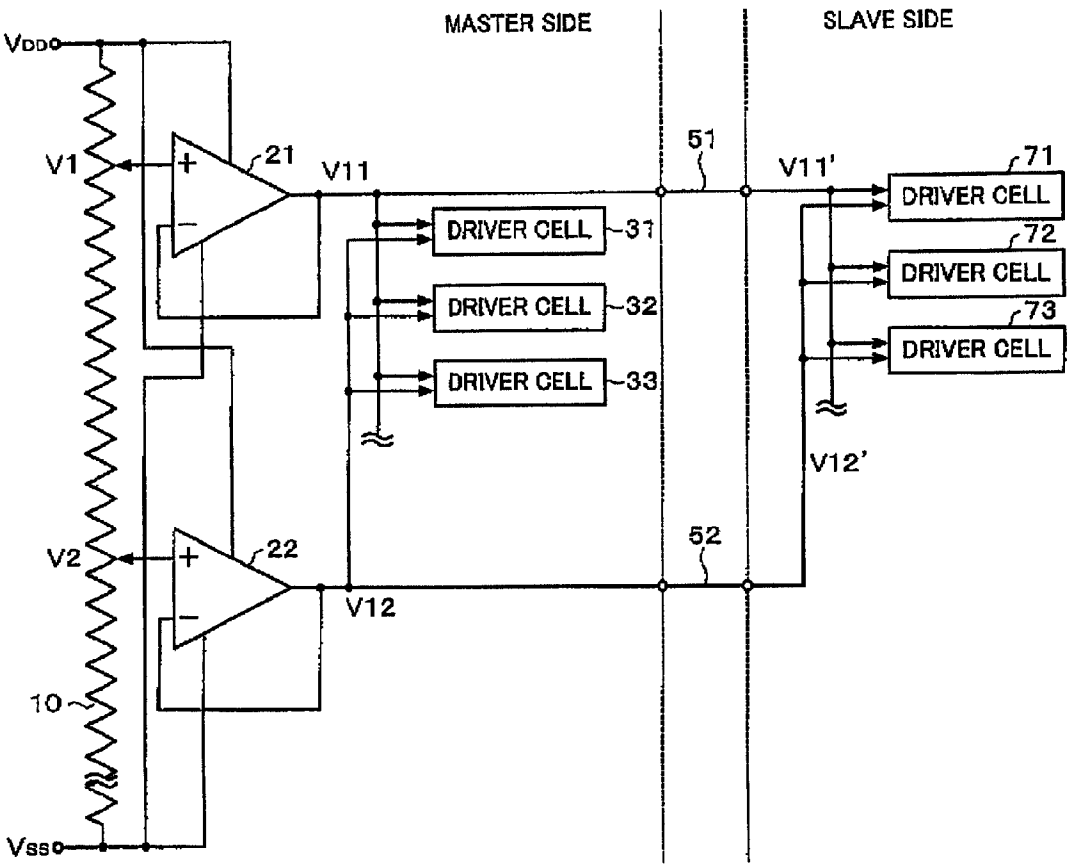
FIG. 8 PRIOR ART
FIG. 8 is a constitutional view schematically showing a constitution of a conventional display device.
Figure 9:
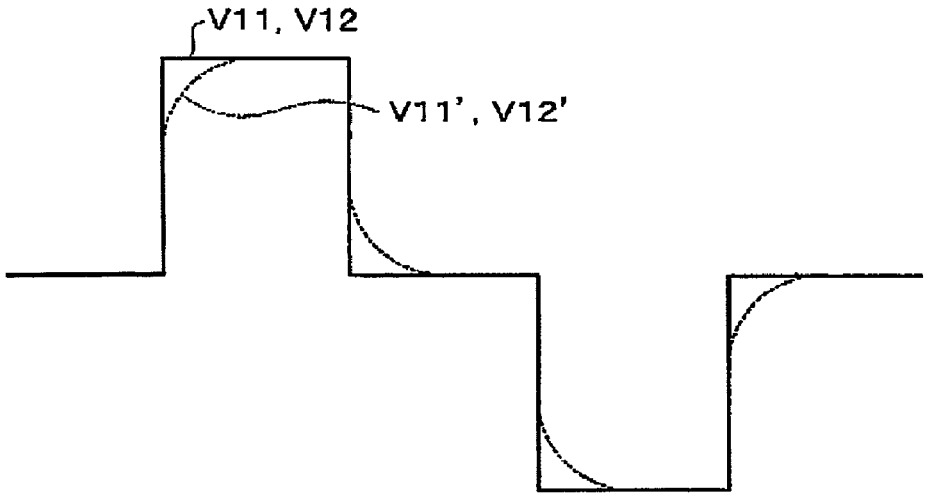
FIG. 9 is an explanatory view showing general waveforms of a power source voltage at a master side and of a power source voltage at a slave side.

However, along with the increase of the capacity of the liquid crystal panel, when the display driving of the liquid crystal panel is to be performed by a plurality of display drivers adopting the COG mounting suitable for the highly dense mounting, since the interconnecting line which electrically connects display drivers is made of a transparent conductive film, the resistance of interconnecting line can not be ignored. As a result, in the constitution shown in FIG. 8, the deterioration of the display quality is brought about by the voltage drop between the display drivers.

Accordingly, as mentioned above, in the display driver at the slave side, the voltages generated at the master side are subjected to impedance conversion by the voltage-follower connected operational amplifiers so as to remarkably increase the input impedance of the operational amplifiers whereby there exists substantially no flow of input current of the operational amplifiers. As a result, substantially no voltage drop is generated between the display driver 40 at the master side and the display driver 42 at the slave side. Accordingly, the deviation in bias or the block irregularities on the screen of the display device can be prevented whereby the deterioration of the display quality can be prevented.

Further, due to the COG mounting, the space saving of a picture frame and the reduction of mounting steps and the number of parts can be realized. At the same time, since the current supply ability at respective display drivers can be increased, it becomes possible to sufficiently drive the liquid crystal panel even when the panel is formed of a large-screen liquid crystal panel with a heavy load.

1.2 Constitutional Example of Display Device

The above-mentioned display devices are explained specifically hereinafter.

Figure 2:
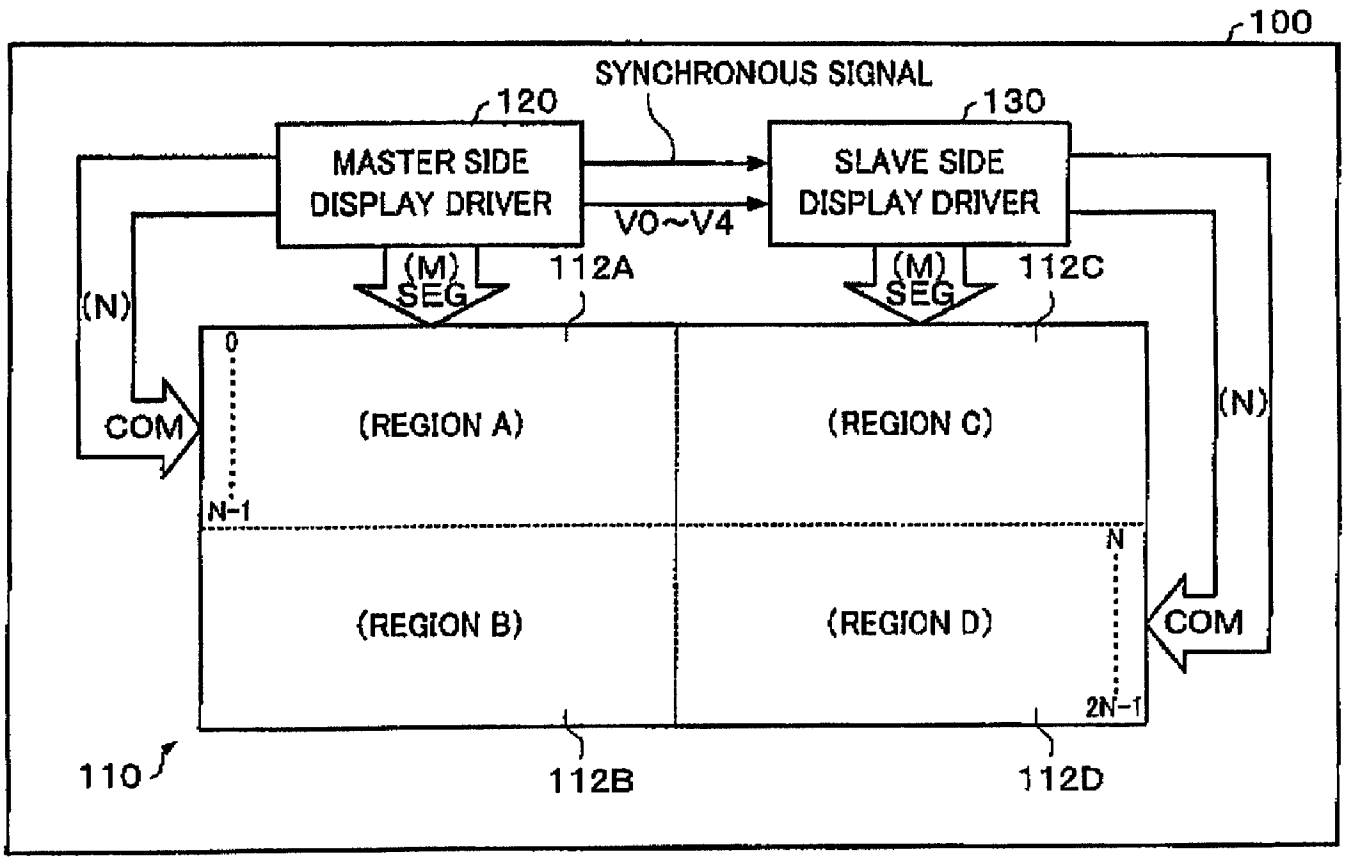
FIG. 2 is a constitutional view showing an example of a specific constitution of a display device according to the first embodiment.

FIG. 2 shows a specific constitutional example of the display device of the first embodiment.

A case in which the display device is driven by the display drivers which are constituted of two chips at the master side and the slave side is explained hereinafter. However, the present invention is not limited to such a case and is applicable to a case in which the display device is driven by the display drivers which adopts a one chip constitution or three or more chip constitution.

In a display device 100, on a glass substrate on which the liquid crystal panel 110 is formed, a display driver 120 at a master side and a display driver 130 at a slave side are mounted.

The liquid crystal panel 110 is constituted of a panel which uses electro-optical elements such as liquid crystal or the like which changes the optical characteristics upon application of voltages. Here, the liquid crystal panel 110 may be constituted of a simple matrix panel, for example. In this case, liquid crystal is filled between a first substrate on which a plurality of segment electrodes (first electrodes, SEG electrodes) are formed and a second substrate on which common electrodes (second electrode, CON electrodes) are formed.

The liquid crystal panel 110 includes liquid crystal display regions 112A to D which are driven by the SEG electrodes and the COM electrodes of the display driver 120 at the master side and the display driver 130 at the slave side.

Here, the display drivers 120, 130 respectively have the similar constitutions, wherein the master mode and the slave mode can be changed over based on a voltage applied to a master/slave (Master/Slave: abbreviated as M/S hereinafter) switching terminal which constitutes an external terminal. Although the explanation will be made on the assumption that the display drivers 120, 130 are subjected to the mode switching using the M/S switching terminal, the mode switching may be performed in software based on the setting of a resistor.

The master mode is a mode which generates the reference voltage for liquid crystal driving voltage of other display drivers when the liquid crystal panel is driven by a plurality of display drivers. The display drivers set in the master mode generate the liquid crystal driving voltages based on voltages generated by voltage generating means incorporated in the display drivers. Further, the slave mode is assumed to be a mode which generates liquid crystal driving voltages based on the reference voltage for the liquid crystal driving voltages generated by the display drivers set in the master mode when the display driving of the liquid crystal panel is performed using a plurality of display drivers.

The display driver 120 at the master side is set in the master mode by the M/S switching terminal and has a function of the display driver 40 at the master side shown in FIG. 1. On the other hand, the display driver 130 at the slave side is set in the slave mode by the M/S switching terminal and has a function of the display driver 42 at the slave side shown in FIG. 1.

When 2×M pieces of SEG electrodes of the liquid crystal panel 110 are prepared and 2×N pieces of CON electrodes of the liquid crystal panel 110 are prepared, the SEG electrodes at the liquid crystal display region 112A of the liquid crystal panel 110 are driven by the display driver 120 at the master side and the CON electrodes are scanned by the display driver 120 at the master side.

The SEG electrodes at the liquid crystal display region 112B are driven by the display driver 120 at the master side and the COM electrodes are scanned by the display driver 130 at the slave side.

The SEG electrodes at the liquid crystal display region 112C are driven by the display driver 130 at the slave side and the COM electrodes are scanned by the display driver 120 at the master side.

The SEG electrodes at the liquid crystal display region 112D are driven by the display driver 130 at the slave side and the COM electrodes are scanned by the display driver 130 at the slave side.

When the display device 100 is driven with the power source voltages V0 to V5 for liquid crystal driving which are generated based on the potential difference between a given power source voltage $V_{DD}$1 at the high potential side and a given power source voltage $V_{SS}$1 at the low potential side, the display driver 120 at the master side generates the power source voltages V0 to V5 for driving liquid crystal using the voltage generating means based on the potential difference between the power source voltage $V_{DD}$1 at the high potential side and the power source voltage $V_{SS}$1 at the low potential side. That is, for example, the divided voltages which are obtained by inserting the resistor between the power source voltage $V_{DD}$1 at the high potential side and the power source voltage $V_{SS}$1 at the low potential side as shown in FIG. 1 can be set as the power source voltages V0 to V5.

The display driver 120 at the master side supplies the above-mentioned power source voltages V0 to V5 for driving the liquid crystal at a plurality of levels and various synchronous signals which become necessary due to the division of the display region to the display driver 130 at the slave side. In FIG. 2. the power source voltage V5 for driving liquid crystal is set to the ground level and only the power source voltages V0 to V4 are supplied to the display driver 130 at the slave side. Further, the above-mentioned synchronous signals include. for example, a liquid crystal AC converting signal FR, a liquid crystal synchronous signal SYNC, a display clock CL, a blanking control signal XDOF for liquid crystal display or the like.

1.3 Constitutional Example of Display Driver

Figure 3:
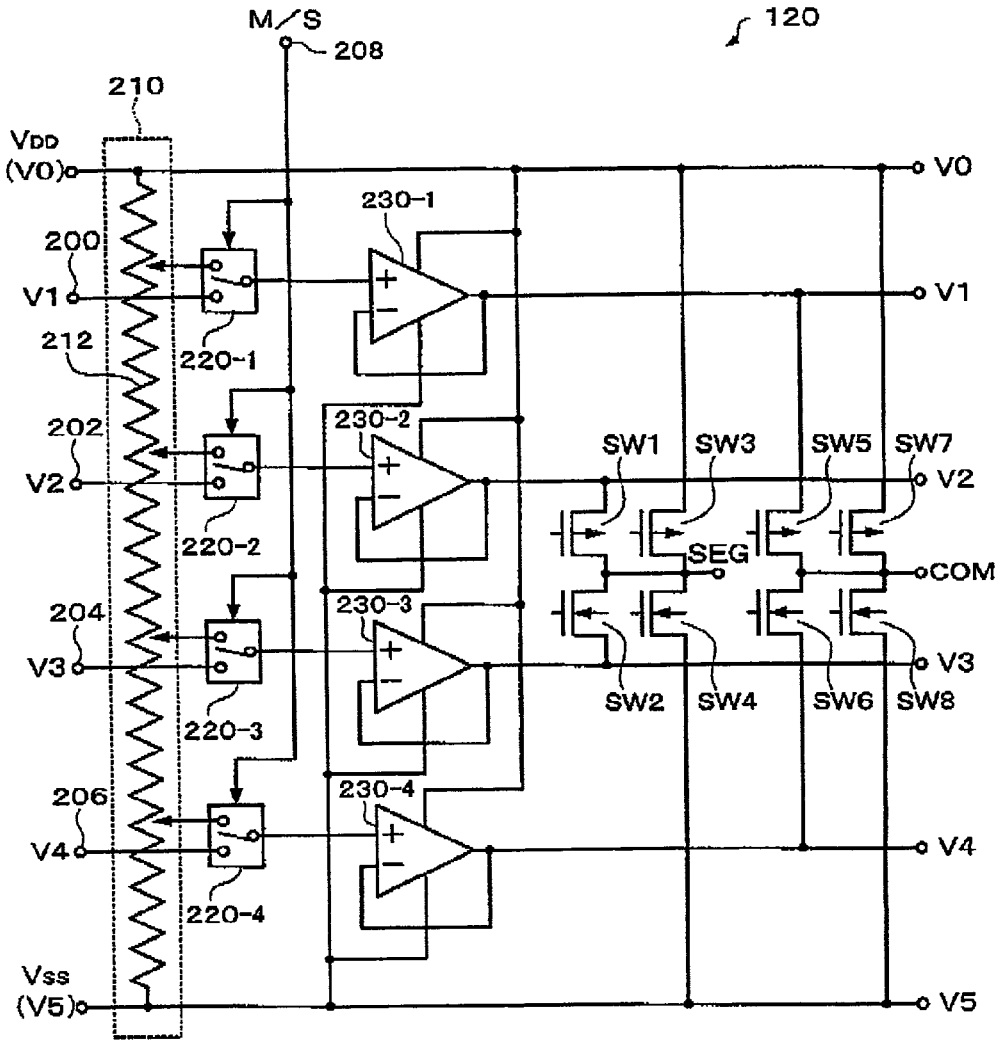
FIG. 3 is a constitutional view showing an example of a constitution of display drivers according to the first embodiment.

FIG. 3 shows an example of the constitution of the display driver 120 which can be changed over between the master mode and the slave mode due to such a M/S switching terminal.

Here, assuming that the display device 100 is driven using the power source voltages V0 to V5 for liquid crystal driving, the display driver 120 shown in FIG. 2 generates the power source voltages V0 to V5 based on the potential difference between the given power source voltage at the high potential side and the given power source voltage at the low potential side. The constitution of the display driver 130 is substantially as same as the above-mentioned constitution of the display driver 120. Further, it is assumed that the power source voltage $V_{DD}$ at the high potential side-is set to V0 and the power source voltage $V_{SS}$ at the low potential side is set to V5 hereinafter.

The display driver 120 includes power source voltage input terminals 200, 202, 204, 206 to which at least the power source voltages V1 to V4 out of the power source voltages V0 to V5 are supplied from the outside and a M/S switching terminal 208 which changes over the master mode and the slave mode. The power source voltages V0, V5 may be generated by a power source circuit in the inside of the display driver 120 or may be supplied from the outside through an external terminal.

Further, the display driver 120 includes a voltage generating part 210, input switching parts 220-1 to 220-4. voltage-follower connected operational amplifiers 230-1 to 230-4, and switching elements SW1 to SW8.

The voltage generating part 210 generates the power source voltages V0 to V5 for driving liquid crystal based on the potential difference between the power source voltage $V_{DD}$(V0) at the high potential side and the power source voltage $V_{SS}$(V5) at the low potential side. Here, the voltage generating part 210 generates the power source voltages V1 to V4 for driving liquid crystal by performing the division by resistance using a resistor 212 which is inserted between the power source voltage $V_{DD}$(V0) at the high potential side and the power source voltage $V_{SS}$(V5) at the low potential side.

The input switching part 220-1 supplies, when the display driver 120 is set in the master mode by the M/S switching terminal 208, the power source voltage V1 which is generated by the voltage generating part 210 to a first terminal (+ terminal) of the operational amplifier 230-1 which is connected in the voltage-follower connection. Further, the input switching part 220-1 supplies, when the display driver 120 is set in the slave mode by the M/S switching terminal 208, the power source voltage which is supplied through the power source voltage input terminal 200 to the first terminal (+ terminal) of the operational amplifier 230-1 which is connected in the voltage-follower connection.

The input switching part 220-2 supplies, when the display driver 120 is set in the master mode by the M/S switching terminal 208, the power source voltage V2 which is generated by the voltage generating part 210 to a first terminal (+ terminal) of the operational amplifier 230-2 which is connected in the voltage-follower connection. Further, the input switching part 220-2 supplies, when the display driver 120 is set in the slave mode by the M/S switching terminal 208, the power source voltage which is supplied through the power source voltage input terminal 202 to the first terminal (+ terminal) of the operational amplifier 230-2 which is connected in the voltage-follower connection.

The input switching part 220-3 supplies, when the display driver 120 is set in the master mode by the M/S switching terminal 208, the power source voltage V3 which is generated by the voltage generating part 210 to a first terminal (+ terminal) of the operational amplifier 230-3 which is connected in the voltage-follower connection. Further, the input switching part 220-3 supplies, when the display driver 120 is set in the slave mode by the M/S switching terminal 208, the power source voltage which is supplied through the power source voltage input terminal 204 to the first terminal (+ terminal) of the operational amplifier 230-3 which is connected in the voltage-follower connection.

The input switching part 220-4 supplies, when the display driver 120 is set in the master mode by the M/S switching terminal 208, the power source voltage V4 which is generated by the voltage generating part 210 to a first terminal (+ terminal) of the operational amplifier 230-4 which is connected in the voltage-follower connection. Further, the input switching part 220-4 supplies, when the display driver 120 is set in the slave mode by the M/S switching terminal 208, the power source voltage which is supplied through the power source voltage input terminal 206 to the first terminal (+ terminal) of the operational amplifier 230-4 which is connected in the voltage-follower connection.

Figure 4:
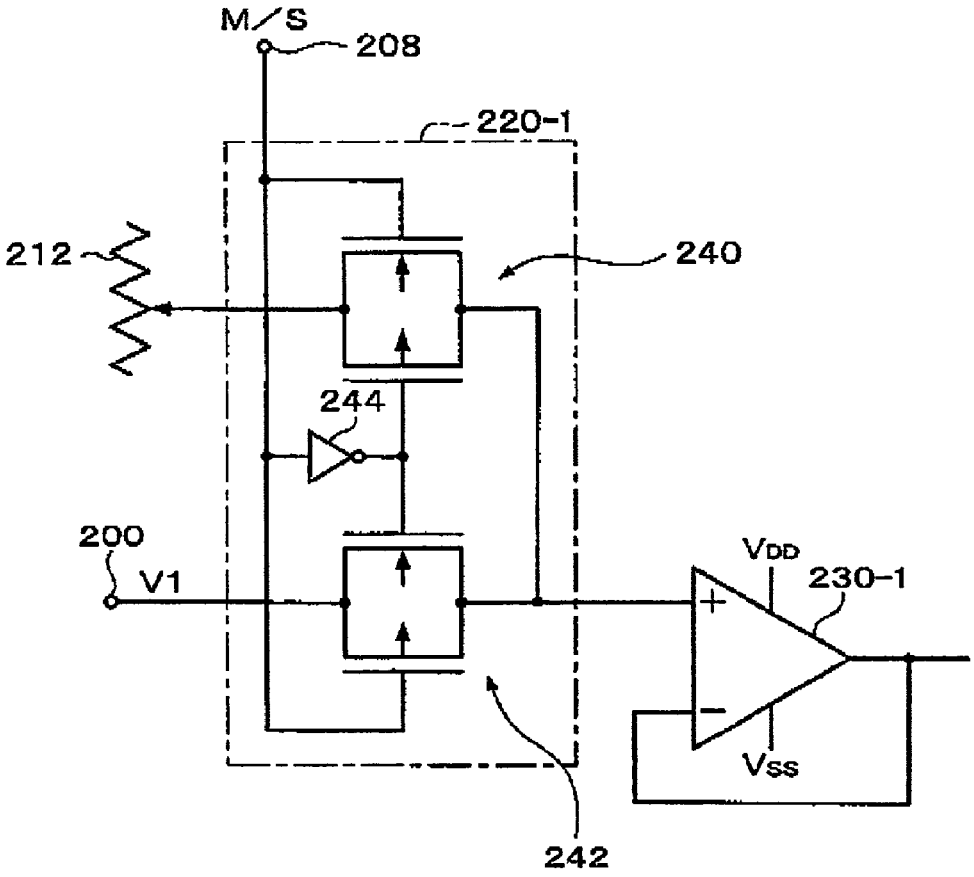
FIG. 4 is an explanatory view showing an example of a constitution of an input switching part of the display driver according to the first embodiment.

FIG. 4 shows an example of the constitution of such an input switching part 220-1.

Although only the input switching part 220-1 is explained here, the input switching parts 220-2 to 220-4 have substantially the same constitution.

The input switching part 220-1 includes first and second transmission gates 240, 242 in which an-channel type transistor (abbreviated as Tr hereinafter) and a p-channel type transistor Tr are connected such that their drain terminals and source terminals are connected with each other, and an inverter element 244.

To a gate electrode of the n-channel type Tr of the first transmission gate 240, a gate electrode of the p-channel type Tr of the second transmission gate 242 and an input terminal of the inverter element 244, the M/S switching terminal 208 is connected. To a gate electrode of the p-channel type Tr of the first transmission gate 240 and a gate electrode of the n-channel type Tr of the second transmission gate 242, an output terminal of the inverter element 244 is connected.

In the input switching part 220-1 having such a constitution, when a voltage which corresponds to a logic level "H" is applied from the M/S switching terminal 208, a voltage which is divided by resistance using a resistor 212 through the first transmission gate 240 is supplied to the first terminal (+ terminal) of the operational amplifier 230-1.

On the other hand, when a voltage which corresponds to a logic level "L" is applied from the M/S switching terminal 208, the power source voltage V1 which is supplied from the outside to the power source voltage input terminal 200 through the second transmission gate 242 is supplied to the first terminal (+ terminal) of the operational amplifier 230-1.

In FIG. 3, the operational amplifiers 230-1 to 230-4 have respective second terminals (− terminals) connected to the output terminals of respective operational amplifiers so that negative feedback loops are formed thus establishing the voltage-follower connections. Further, the power source voltage $V_{DD}$ at the high potential side and the power source voltage $V_{SS}$ at the low potential side are supplied to the operational amplifiers 230-1 to 230-4 and the operational amplifiers 230-1 to 230-4 output voltages V1, V2, V3, V4 which are substantially equal to these input voltages. Either one of the power source voltage $V_{DD}$ at the high potential side and the power source voltage $V_{SS}$ at the low potential side may be used as a ground potential.

The switching elements SW1 to SW4 are provided for applying any one of the power source voltages V0, V2, V3, V5 to the SEG electrodes based on the display data. These switching elements are respectively provided to the SEG electrodes.

The switching elements SW5 to SW8 are provided for applying any one of the power source voltages V0, V1, V4, V5 to the COM electrodes based on the display data. These switching elements are respectively provided to the COM electrodes.

1.4 Two Chip Constitution at the Master Side and the Slave Side

Figure 5:
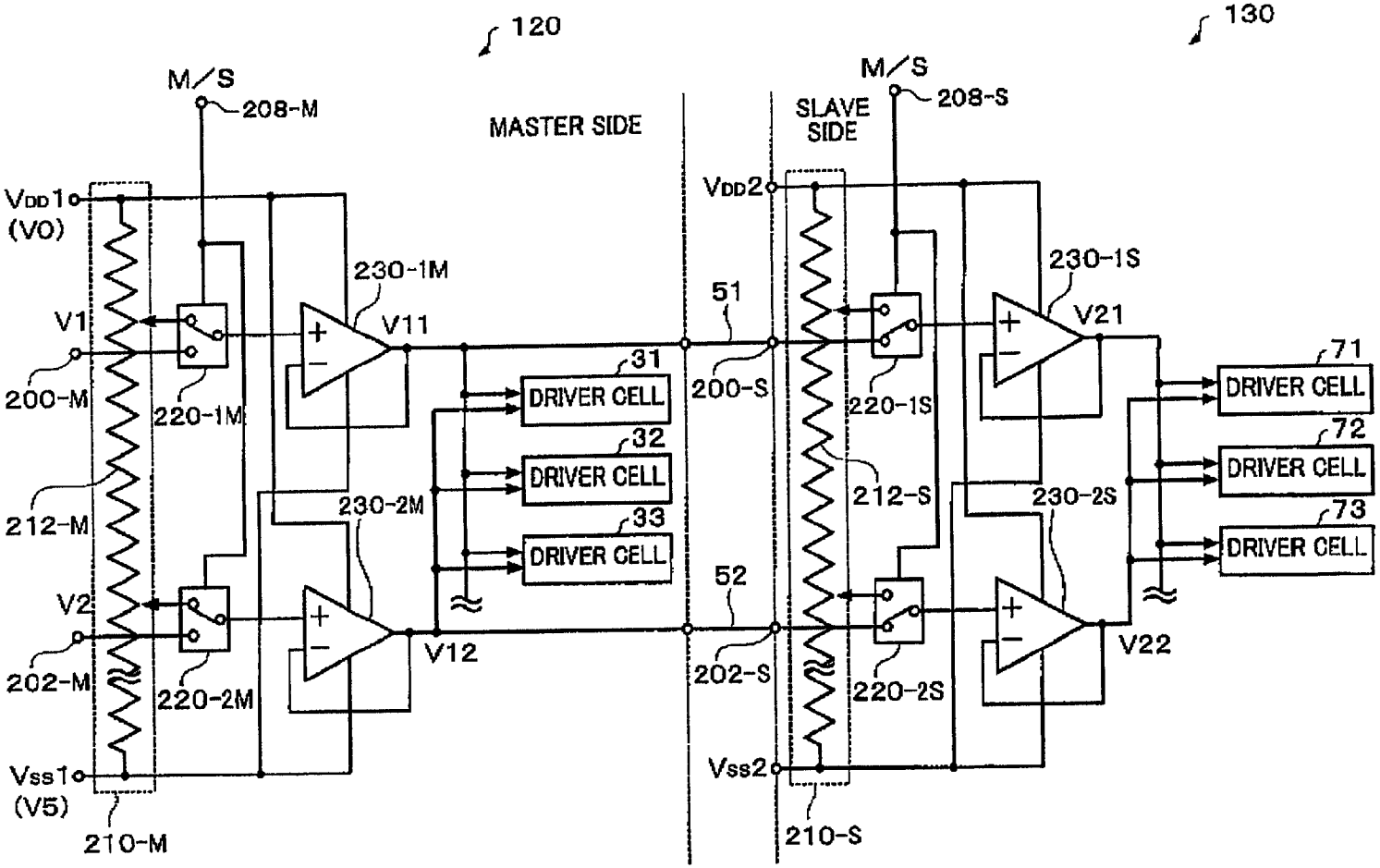
FIG. 5 is an explanatory view showing a general constitution of the display drivers according to the first embodiment when the display drivers are applied to the display device in a two chip constitution.

FIG. 5 shows the general constitution of the display driver which is shown in FIG. 3 and FIG. 4 when the display driver has the two chip constitution and is applied to the display device shown in FIG. 2.

However, to simplify the explanation here, it is assumed that two voltages V1, V2 are generated and parts which are identical with parts shown in FIG. 1 to FIG. 3 and FIG. 8 are indicated by same numerals and their explanation is omitted depending on the situation.

In a display driver 120 at the master side which is set in such a master mode, at input switching parts 220-1M, 220-2M, power source voltages V1, V2 which are obtained by dividing the potential difference between a power source voltage $V_{DD}$1 (V0) at the high potential side and a power source voltage $V_{SS}$1 (V5) at the low potential side by a resistor 212-M are supplied to first terminals (+ terminals) of voltage-follower connected operational amplifiers 230-1M, 230-2M.

Voltages V11, V12 which are outputted from the operational amplifiers 230-1M, 230-2M are supplied to a series of driver cells 31, 32, 33, . . . for driving liquid crystal as power sources. Further, these voltages V11, V12 are supplied to a display driver 130 at the slave side through transparent conductive films 51, 52 which are formed on an interconnect layer on a glass substrate.

The driver cells 31, 32, 33, . . . for driving liquid crystal, as shown in FIG. 2, drive SEG electrodes and COM electrodes of the liquid crystal display regions 112A, 112B.

The display driver 130 at the slave side is set in the slave mode as shown in FIG. 5 and, at input switching parts 220-1S, 220-2S, the power source voltages V1, V2 which are supplied to the power source voltage input terminals 200-S, 202-S through transparent conductive films 51, 52 are supplied to first terminals (+ terminals) of voltage-follower connected operational amplifiers 230-1S, 230-2S.

Since the operational amplifiers 230-1S, 230-2S are constituted by adopting the voltage-follower connection, the feedback factors of the operational amplifiers become extremely large so that the input impedance of the operational amplifiers also become extremely large whereby there exists substantially no flow of the input current. Accordingly, the voltage drop is hardly generated between the display driver 120 at the master side and the display driver 130 at the slave side. As a result, the output voltages of respective operational amplifiers 230-1S, 230-2S substantially become equal to the input voltages of respective operational amplifiers 230-1S, 230-2S so that the voltages V21, 22 which are outputted from the operational amplifiers 230-1S, 230-2S respectively become substantially equal to the voltages V11, V12 which are outputted from the operational amplifiers 230-1M, 230-2M of the master side display driver 40.

Further, the voltages V21, V22 which are outputted from the operational amplifiers 230-1S, 230-2S of the display driver 130 at the slave side are supplied to a series of driver cells 71, 72, 73, . . . for driving liquid crystal.

The driver cells 71, 72, 73, . . . for driving liquid crystal, as shown in FIG. 2, drive the SEG electrodes and the COM electrodes in the liquid crystal display regions 112C, 112D.

In this manner, by making the voltage generated at the master side subjected to the impedance conversion using the operational amplifiers adopting the voltage-follower connection, the input impedance of the operational amplifiers can be made extremely large so that there exists substantially no flow of the input current to the operational amplifiers. As a result, the voltage drop is hardly generated between the display driver 120 at the master side and the display driver 130 at the slave side. Therefore, the deviation in bias and the block irregularities on the screen of the display device can be prevented so that the deterioration of the display quality can be prevented.

Further, the display driver is constituted such that the mode thereof is changed over by the external M/S switching terminal to that the manufacturing cost of the display driver chips suitable for the above-mentioned display driving can be reduced. As a result, due to the reduction of the cost of the COG mounting and the driver, it becomes possible to provide the display device which can cope with the requirement for the high quality of the display at a low cost even when the capacity of the liquid crystal panel is increased.

Second Embodiment

Although the first embodiment is explained on the assumption that the liquid crystal panel is formed of a passive matrix panel such as a simple matrix panel or the like, the liquid crystal panel is not limited to such a panel. In a display device according to the second embodiment, a liquid crystal panel formed on a glass substrate includes an active matrix panel which uses three terminal elements or two terminal elements such as thin film transistors (TFT), thin film diodes (TFD) or the like.

2.1 Summary of the Display Device

Figure 6:
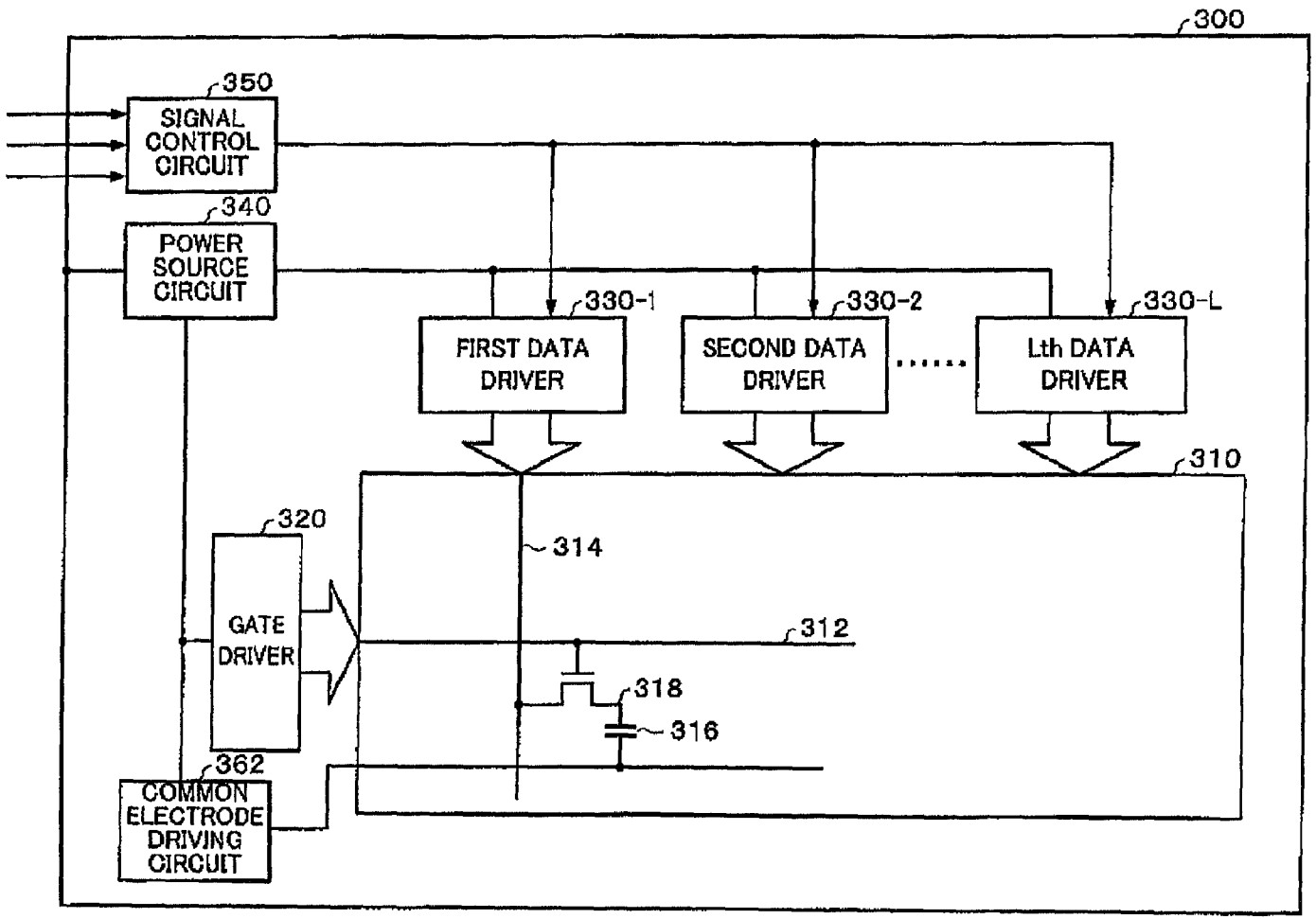
FIG. 6 is a constitutional view showing a general structure of a display device according to the second embodiment.

FIG. 6 shows the general constitution of a display device 300 according to the second embodiment.

In the display device 300, a TFT type liquid crystal panel 310 is formed on a glass substrate. On the glass substrate, as a circuit which drives the TFT type liquid crystal panel 310, a gate driver 320 which is connected to a gate line (scanning line) 312 and first to Lth data drivers 330-1 to 330-L which are connected to data lines (signal lines) 314 corresponding to pixels which perform display driving are mounted.

Further, on the glass substrate on which the TFT type liquid crystal panel 310 is formed, a power source circuit 340 which supplies power source voltages at one or a plurality of levels to respective parts mounted on the same substrate through transparent conductive films, signal control circuits 350 which perform the display driving of the gate driver 320 and the first to Lth data drivers 330-1 to 330-L based on the display data are mounted.

The power source circuit 340 includes a gray scale voltage circuit part which generates a reference voltage necessary for the gray scale driving and supplies this reference voltage to the first to the Lth data drivers 330-1 to 330-L. The first to the Lth data drivers 330-1 to 330-L supply, based on the gray scale data of respectively corresponding display regions, the driving voltages which are generated based on the reference voltage supplied from the power source circuit 340 to-the data line 314. It is assumed that these first to Lth data drivers 330-1 to 330-L substantially have the same constitution.

In the TFT type liquid crystal panel 310, a liquid crystal capacity 316 is formed by inserting the liquid crystal between a pixel electrode 318 and a common electrode 360. A common voltage is supplied to the common electrode 360 from a common electrode driving circuit 362.

2.2 Summary of the Display Driver

Figure 7:
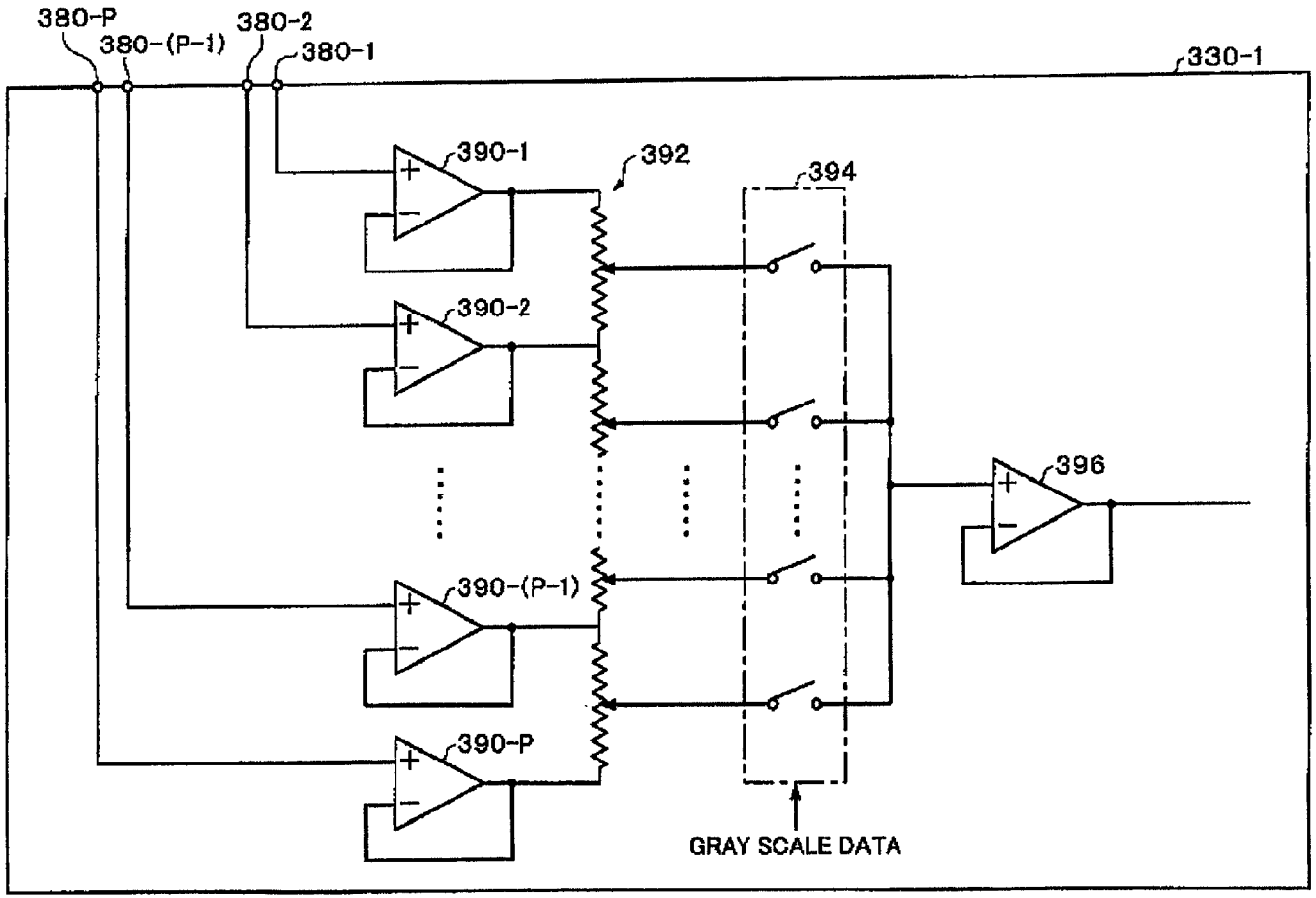
FIG. 7 is a constitutional view showing a general constitution of an essential part of a constitution of the data drivers in the second embodiment.

FIG. 7 shows the general constitution of an essential part of the constitution of the above-mentioned data driver.

In the data driver 330, the reference voltages at a plurality of levels necessary for the gray scale driving are supplied to reference voltage supply terminals 380-1 to 380-P from the power source circuit 340 mounted on the same glass substrate through the transparent conductive film. The reference voltages supplied to the reference voltage supply terminals 380 are respectively supplied to first terminals (+ terminals) of the respective voltage-follower connected operational amplifiers 390-1 to 390-P.

A resistor 392 is inserted between output terminals of the operational amplifier 390-1 and the operational amplifier 390-P and respective output terminals of the operational amplifiers 390-2 to 390-(p−1) are connected to given resistance division points on the resistor 392.

The data driver 330 is provided with a drive voltage generating circuit part 394 which selects a driving voltage necessary for the gray scale driving based on the gray scale data of a pixel which is subjected to the display driving. The driving voltage generating circuit part 394 selectively selects a voltage outputted from an arbitrary resistance division point using the output voltages of the respective operational amplifiers 390-1 to 390-P as the reference voltages. The voltage outputted from the driving voltage generating circuit part 394 is subjected to the impedance conversion by the operational amplifier 396 which is connected in a voltage-follower connection and thereafter is supplied to the data line 314 of the TFT type liquid crystal panel 310.

In this manner, with respect to the display device including the COG-mounted power source circuit and a plurality of data drivers, when the reference voltages at a plurality of levels which are necessary for the gray scale driving of the active matrix panel generated at the power source circuit are supplied to the respective data drivers through the transparent conductive film whose interconnect resistance cannot be ignored, the impedance conversion is performed at each data driver by the operational amplifier connected in a voltage-follower manner to generate the gray scale driving voltages. Due to such a constitution, the input impedance of the operational amplifier can be extremely increased so that there is substantially no flow of the input current to the operational amplifier. As a result, the voltage drop is hardly generated between the power source circuit 340 and the respective data drivers 330-1 to 330-L. Accordingly, the deviation in bias and the block irregularities on the screen of the display device can be prevented so that the deterioration of the display quality can be prevented.

The present invention is not limited to the above-mentioned embodiments and various modifications can be considered within a scope of the gist of the present invention.

Further, although the first embodiment and the second embodiment have been explained with respect to the case in which the liquid crystal panel is mounted as the display device, the present invention is not limited to this case. The present invention is applicable to a display device using other panel. For example, the present invention is applicable to a display panel whose display is controlled based on the voltage.

Still further, although the first embodiment and the second embodiment explain the driving circuit for driving the display device, the present invention is not limited to such a driving device. The present invention is preferably used for suppressing the drop of the power source voltage between the supply side and the reception side when the voltage is supplied through the interconnecting line which has the interconnect resistance not less than the output impedance of the voltage supply circuit (the operational amplifier connected in a voltage-follower manner in FIG. 1, FIG. 3 and FIG. 5, for example) which supplies various voltages.

What is claimed is:

1. A display driver which drives a display panel, comprising:

voltage generating means which generates a given voltage;

a voltage-follower-type operational amplifier circuit which generates a driving voltage based on the given voltage; and switching means for causing the voltage-follower-type operational amplifier circuit to generate the driving voltage based on the given voltage in a first mode and causing the voltage-follower-type operational amplifier circuit to generate the driving voltage based on an external voltage in a second mode, wherein, when the display panel is driven by a plurality of the display drivers, the first mode is a mode which generates a reference voltage for the driving voltage which is generated by another display driver, and wherein, when the display panel is driven by a plurality of the display drivers, the second mode is a mode which generates the driving voltage based on the reference voltage generated by the display driver set in the first mode.

2. The display driver according to claim 1, wherein the display driver is mounted on a glass substrate on which a display panel is formed, and wherein the external voltage supply in the second mode is supplied through a transparent conductive film formed on the glass substrate.

3. The display driver according to claim 2, wherein the voltage generating means generates the given voltage by dividing a potential difference between a given power source voltage at a high potential side and a given power source voltage at a low potential side by a resistor.

4. The display driver according to claim 1, wherein the voltage generating means generates the given voltage by dividing a potential difference between a given power source voltage at a high potential side and a given power source voltage at a low potential side by a resistor.

5. The display driver according to claim 1, wherein the display panel is a simple matrix panel.

6. A display device, comprising:

first and second display drivers, wherein each of the first and second display drivers includes:

voltage generating means which generates a given voltage, a voltage-follower-type operational amplifier circuit which generates a driving voltage based on the given voltage, and switching means for causing the voltage-follower-type operational amplifier circuit to generate the driving voltage based on the given voltage in a first mode and causing the voltage-follower-type operational amplifier circuit to generate the driving voltage based on an external voltage in a second mode, wherein:

the first display driver is set in a first mode, and the second display driver is set in a second mode, and the driving voltage generated by the first display driver is supplied as the external voltage to the second display driver; and a display panel which is driven based on the voltage generated at least by the second display driver, wherein the first and second display drivers are mounted on a glass substrate on which the display panel is formed, and wherein the driving voltage generated by the first display driver is supplied to the second display driver through a transparent conductive film which is formed on the glass substrate.

7. The display device according to claim 6, wherein, when the display panel is driven by a plurality of the display drivers including the first and second display drivers, the first mode is a mode which generates a reference voltage for the driving voltage which is generated by another display driver, and wherein, when the display panel is driven by a plurality of the display drivers including the first and second display drivers, the second mode is a mode which generates the driving voltage based on the reference voltage generated by the display driver set in the first mode.

8. The display device according to claim 6, wherein the transparent conductive film has interconnect resistance which is not less than output impedance of the voltage-follower-type operational amplifier circuit of the first display driver.

9. The display device according to claim 7, wherein the transparent conductive film has interconnect resistance which is not less than output impedance of the voltage-follower-type operational amplifier circuit of the first display driver.

10. A display device, comprising:

first and second display drivers, wherein each of the first and second display drivers includes:

voltage generating means which generates a given voltage, a voltage-follower-type operational amplifier circuit which generates a driving voltage based on the given voltage, and switching means for causing the voltage-follower-type operational amplifier circuit to generate the driving voltage based on the given voltage in a first mode and causing the voltage-follower-type operational amplifier circuit to generate the driving voltage based on an external voltage in a second mode, wherein:

the first display driver is set in a first mode, and the second display driver is set in a second mode, and the driving voltage generated by the first display driver is supplied as the external voltage to the second display driver; and a display panel which is driven based on the voltage generated at least by the second display driver, wherein the first and second display drivers are mounted on a glass substrate on which the display panel is formed, wherein the driving voltage generated by the first display driver is supplied to the second display driver through a transparent conductive film which is formed on the glass substrate, and wherein the external voltage in the second mode is supplied through a transparent conductive film formed on the glass substrate.

11. The display device according to claim 10, wherein, when the display panel is driven by a plurality of the display drivers including the first and second display drivers, the first mode is a mode which generates a reference voltage for the driving voltage which generated by another display driver, and wherein, when the display panel is driven by a plurality of the display drivers including the first and second display drivers, the second mode is a mode which generates the driving voltage based on the reference voltage generated by the display driver set in the first mode.

12. The display device according to claim 10, wherein the transparent conductive film has interconnect resistance which is not less than output impedance of the voltage-follower-type operational amplifier circuit of the first display driver.

13. The display device according to claim 11, wherein the transparent conductive film has interconnect resistance which is not less than output impedance of the voltage-follower-type operational amplifier circuit of the first display driver.

14. A display device, comprising:

a display panel which is formed on a glass substrate, and a plurality of display drivers which are mounted on the glass substrate and drive the display panel, wherein each of the display drivers includes a plurality of voltage-follower-type operational amplifier circuits which generate driving voltage for the driving the display panel based on a power source voltage supplied through an interconnecting line formed on the glass substrate, wherein the voltage supplied through the interconnecting line is gray scale driving voltage, and impedance conversion is performed at each of the display drivers.

15. The display device according to claim 14, wherein the display panel is an active matrix panel.

* * * * *